US011211678B2

(12) United States Patent
Sekiya et al.

(10) Patent No.: US 11,211,678 B2
(45) Date of Patent: Dec. 28, 2021

(54) DUAL-BAND RESONATOR AND DUAL-BAND BANDPASS FILTER USING SAME

(71) Applicants: TOKYO KEIKI INC., Tokyo (JP); THE JAPAN STEEL WORKS, LTD., Tokyo (JP); UNIVERSITY OF YAMANASHI, Yamanashi (JP)

(72) Inventors: Naoto Sekiya, Yamanashi (JP); Takahiro Unno, Yamanashi (JP); Tsutomu Tsuruoka, Tokyo (JP); Kazuhito Kishida, Tokyo (JP); Yasuo Sato, Kanagawa (JP); Noritaka Kitada, Kanagawa (JP)

(73) Assignees: TOKYO KEIKI INC., Tokyo (JP); THE JAPAN STEEL WORKS, LTD., Tokyo (JP); UNIVERSITY OF YAMANASHI, Yamanashi (JP)

( * ) Notice: Subject to any disclaimer, the term of this patent is extended or adjusted under 35 U.S.C. 154(b) by 160 days.

(21) Appl. No.: 16/608,245

(22) PCT Filed: Apr. 27, 2018

(86) PCT No.: PCT/JP2018/017180
§ 371 (c)(1),
(2) Date: Oct. 25, 2019

(87) PCT Pub. No.: WO2018/203521
PCT Pub. Date: Nov. 8, 2018

(65) Prior Publication Data

US 2020/0194856 A1 Jun. 18, 2020

(30) Foreign Application Priority Data

May 1, 2017 (JP) ..... JP2017-091025

(51) Int. Cl.
*H01P 1/203* (2006.01)
*H01P 7/08* (2006.01)
*H01P 7/10* (2006.01)

(52) U.S. Cl.
CPC ..... *H01P 1/20309* (2013.01); *H01P 7/088* (2013.01); *H01P 7/105* (2013.01)

(58) Field of Classification Search
CPC .. H01P 1/20; H01P 7/088; H01P 7/105; H01P 1/203; H01P 1/20309; H03H 7/0161
(Continued)

(56) References Cited

U.S. PATENT DOCUMENTS

2009/0146762 A1 6/2009 Shiokawa et al.
2010/0188171 A1* 7/2010 Mohajer-Iravani ... H01P 1/2053 333/175
2016/0164485 A1 6/2016 Sekiya et al.

FOREIGN PATENT DOCUMENTS

CN 102509822 A 6/2012
CN 104466319 A 3/2015
(Continued)

OTHER PUBLICATIONS

Haiwen Liu, Baoping Ren, Fan Liu, Xuehui Guan, Pin Wen, Zhewang Ma, "Dual-Band High-Temperature Superconducting Bandpass Filter Using Dual-Mode Hairpin Ring Resonator", IEEE Transactions on Applied Superconductivity, vol. 26, No. 7, IEEE, 2016; 4 pages.
(Continued)

*Primary Examiner* — Rakesh B Patel
(74) *Attorney, Agent, or Firm* — Cantor Colburn LLP

(57) ABSTRACT

Provided is a dual-band resonator which can be downsized further than conventional ones. A dual-band resonator is provided with a first conductor and a second conductor. The first conductor is configured to be folded at a first folding
(Continued)

part at the center so that both extensions are in a prescribed direction and adjacent to one another with a prescribed space therebetween, wherein a conductor part closer to one end side than the first folding part and a conductor part closer to the other end side than the first folding part are further folded at second folding parts between the one end and the first folding part and between the other end and the first folding part, respectively, in a direction in which the one end and the other end are apart from each other. The second conductor extends in a prescribed direction contiguously to the first folding part of the first conductor. The first conductor constitutes a half-wavelength resonator, and odd-mode resonance occurs in the first conductor. The first conductor and the second conductor constitute a half-wavelength resonator, and even-mode resonance occurs in the first conductor and the second conductor.

9 Claims, 16 Drawing Sheets

(58) Field of Classification Search
USPC ..... 333/204, 205, 219, 238
See application file for complete search history.

(56) References Cited

FOREIGN PATENT DOCUMENTS

| | | | |
|---|---|---|---|
| JP | 2009130699 | A | 6/2009 |
| JP | 2014236362 | A | 12/2014 |
| JP | 2015015560 | A | 1/2015 |
| JP | 2015142297 | A | 8/2015 |
| JP | 2016111671 | A | 6/2016 |

OTHER PUBLICATIONS

International Search Report corresponding to Application No. PCT/JP2018/017180; dated Jul. 3, 2018.

Naoto Sekiya, Shunsuke Sugiyama, "Design of Miniaturized HTS Dual-Band Bandpass Filters Using Stub-Loaded Meander Line Resonators and Their Applications to Tri-Band Bandpass Filters", IEEE Transactions on Applied Superconductivity, vol. 25, No. 3, IEEE, 2015; 5 pages.

CNIPA Office Action for corresponding CN Application No. 201880028211.2; dated Oct. 26, 2020.

* cited by examiner

DUAL-BAND RESONATOR AND DUAL-BAND BANDPASS FILTER USING SAME

CROSS REFERENCE TO RELATED APPLICATIONS

This is the U.S. national stage of application No. PCT/JP2018/017180, filed on Apr. 27, 2018. Priority under 35 U.S.C. § 119(a) and 35 U.S.C. § 365(b) is claimed from Japanese Patent Application No. 2017-091025, filed May 1, 2017; the disclosures of which are incorporated herein by reference.

TECHNICAL FIELD

The present invention relates to a dual-band resonator which resonates at two different frequencies, and a dual-band bandpass filter made using this.

BACKGROUND ART

In recent years, due to an increase in the utilization of wireless communication terminals such as smartphones and tablets, and an increase in the utilization of large capacity contents such as video, the data traffic has increase at a pace of 1.5 times per year, and the increasing trend continuing from now on is expected.

Therefore, each carrier has introduced carrier aggregation (CA) technology of performing communication using a plurality of frequency bands simultaneously in order to make a higher speed/larger volume network. With this CA technology, a multi-band bandpass filter is necessary which allows signals of a plurality of frequency bands to pass simultaneously.

Patent Documents 1 and 2 disclose dual-band bandpass filters which allow signals of two frequency bands to pass simultaneously. The dual-band resonator constituting this dual-band bandpass filter simultaneously realizes two frequency bands using two modes generated by one resonator. More specifically, the dual-band resonator is formed as a strip conductor on a top surface of a dielectric on which a ground conductor is arranged on the lower surface, and has a structure adding a stub (second conductor) to a half-wavelength resonator (First conductor). With this dual-band resonator, an odd-mode resonation occurs in the half-wavelength resonator, and an even-mode resonation occurs in the half-wavelength resonator and stub. By sharing one resonator in two frequency bands in this way, it is possible to realize more of a size reduction of the dual-band resonator and dual-band bandpass filter than using two independent resonators.

Patent Document 1: Japanese Unexamined Patent Application, Publication No. 2014-236362

Patent Document 2: Japanese Unexamined Patent Application, Publication No. 2016-111671

DISCLOSURE OF THE INVENTION

Problems to be Solved by the Invention

The present invention has an object of providing a dual-band resonator capable of a further reduction in size compared to conventionally, and a dual-band bandpass filter made using this.

Means for Solving the Problems

A dual-band resonator according to a first aspect of the present invention is a dual-band resonator which resonates at two different frequencies, and includes: a first conductor and a second conductor which are formed on a dielectric having a ground conductor or inside a dielectric having a ground conductor, in which the first conductor is folded in a U shape by a first folding part in a central part, and extends in a predetermined direction adjacently at a predetermined interval; a one-end-side conductor portion which is more to one end side of the first conductor than the first folding part and an other-end-side conductor portion which is more to an other end side of the first conductor than the first folding part become a structure further folded in a direction in which one end and an other end distance from each other, at second folding parts between the one end, the other end and the first folding part; the second conductor has one end connected to the first folding part of the first conductor, and extends in the predetermined direction continuously to the first conductor; both ends of the first conductor are open, the first conductor constitutes a half-wavelength resonator, and odd-mode resonance resonating at one frequency among the two frequencies is produced at the first conductor; and an other end of the second conductor is open, the first conductor and the second conductor constitute a half-wavelength resonator, and even-mode resonance resonating at an other frequency among the two frequencies is produced at the first conductor and the second conductor.

According to a second aspect of the present invention, in the dual-band resonator as described in the first aspect, the one-end-side conductor portion and the other-end-side conductor portion may form a structure further folded in a direction in which the second folding parts distance from each other, at third folding parts between the one end, the other end, and the first folding part and the second folding part.

According to a third aspect of the present invention, in the dual-band resonator as described in the second aspect, the first folding part, the one end, and the second folding part may be arranged in order in a cross direction intersecting the predetermined direction, in the one-end-side conductor portion; and the first folding part, the other end and the second folding part may be arranged in order in the cross direction in the other-end-side conductor portion.

According to a fourth aspect of the present invention, in the dual-band resonator as described in the third aspect, the first folding part, the one end and the second folding part may be arranged linearly in the cross direction in the one-end-side conductor portion; and the first folding part, the other end and the second folding part may be arranged linearly in the cross direction in the other-end-side conductor portion.

According to a fifth aspect of the present invention, in the dual-band resonator as described in any one of the first to fourth aspects, the second conductor may be established as a stepped-impedance structure by making the first conductor thinner than the second conductor.

According to a sixth aspect of the present invention, in the dual-band resonator as described in any one of the first to fifth aspects, a recessed part or convex part may be formed at an end part of the second conductor on a side of the other end thereof.

A dual-band bandpass filter according to a seventh aspect of the present invention includes one or a plurality of the dual-band resonators as described in any one of the first to sixth aspects.

According to an eighth aspect of the present invention, the dual-band bandpass filter as described in the seventh aspect may further include: a plurality of dual-band resonators arranged so as to satisfy a coupling coefficient of odd-mode resonance; and one or a plurality of waveguides provided between second conductors of the plurality of the dual-band resonators so as to satisfy a coupling coefficient of even-mode resonance.

According to a ninth aspect of the present invention, the dual-band bandpass filter as described in the eighth aspect may further include a pair of feeder lines provided so as to interpose the plurality of the dual-band resonators, and coupled independently to a first conductor and a second conductor of the dual-band resonator.

Effects of the Invention

According to the present invention, it is possible to provide a dual-band resonator capable of a further size reduction compared to conventionally, and a dual-band bandpass filter made using this.

PREFERRED MODE FOR CARRYING OUT THE INVENTION

Hereinafter, an example of an embodiment of the present invention will be explained by referencing the attached drawings. It should be noted that the same reference symbol shall be assigned to identical or corresponding portions in the respective drawings.

First, before explaining the present embodiment, a conventional dual-band resonator and dual-band bandpass filter which were devised by the inventors of the present disclosure will be explained.

(Conventional Dual-Band Resonator)

Figure 1:
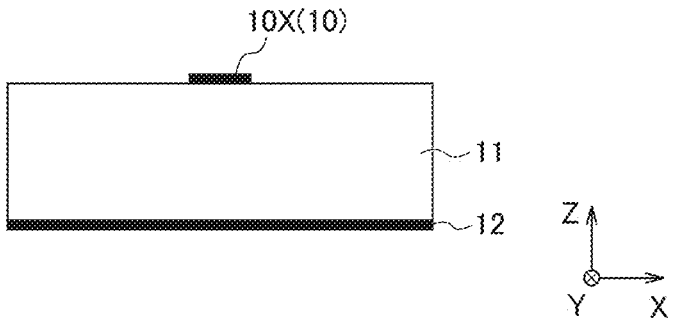
FIG. 1 is a side view of a conventional dual-band resonator.
Figure 2:
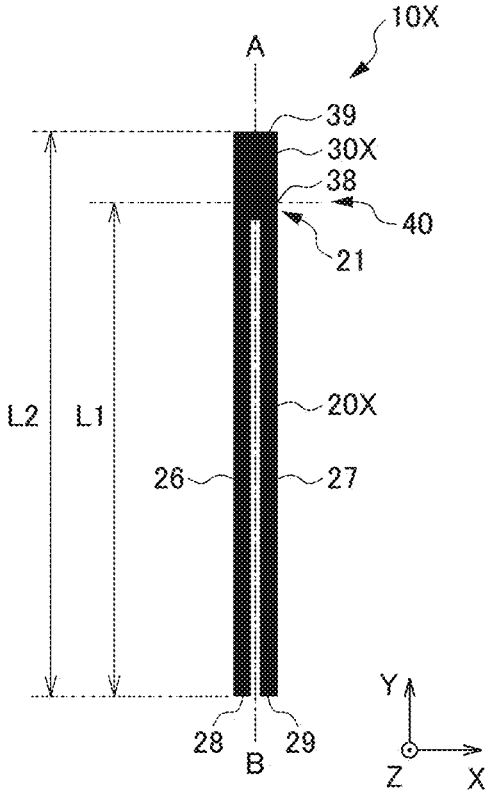
FIG. 2 is a plan view of a conventional dual-band resonator.

FIG. 1 is a side view of a conventional dual-band resonator, and FIG. 2 is a plan view of a conventional dual-band resonator. FIG. 1 and FIG. 2 show an XYZ Cartesian coordinate system. The X direction (cross direction) is the width direction of a filter described later, the Y direction (predetermined direction) is a length direction of the filter, and the Z direction is a height direction of the filter.

As shown in FIG. 1, the conventional dual-band resonator 10X is configured by conductors of a microstrip line structure formed on a dielectric 11. On the back surface of the dielectric 11, a ground conductor 12 which is grounded is formed. It should be noted that the dual-band resonator 10X may be configured by a conductor of a strip line structure formed inside of a dielectric, or may be configured by a conductor of a coplanar line or grounded coplanar line structure formed on the dielectric.

As the dielectric 11, it is possible to use a well-known dielectric. For example, a material excelling in moldability may be used as the material of the dielectric 11. In addition, in order to reduce the dielectric loss, a material having low dielectric dissipation factor may be used as the material of the dielectric 11. In addition, in order to reduce the temperature rise, a material having high thermal conductivity may be used as the material of the dielectric 11.

It is possible to use well-known conductors also as the conductors constituting the dual-band resonator 10X and the ground conductor 12. For example, a normal conductor may be used as the conductor. In addition, in order to reduce the conductor loss, a superconductor may be used as the conductor.

As shown in FIG. 2, the dual-band resonator 10X includes a first conductor 20X and a second conductor 30X.

The first conductor 20X assumes a so-called hair-pin shape. More specifically, the first conductor 20X assumes a structure folded back in a U shape at a first folding part 21 at the central part of a linear conductor. A conductor portion 26 more to a one end 28 side than the first folding part 21 and a conductor portion 27 more to the other end 29 side than the first folding part 21 extend in the Y direction adjacently at a predetermined interval. Both ends 28, 29 of the first conductor 20X are open, and the first conductor 20X configures a U-shaped half-wavelength resonator.

The second conductor 30X assumes a so-called stub shape. More specifically, in the second conductor 30X, one end 38 is connected to the first folding part 21 of the first conductor 20X, and extends in the Y direction continuously to the first conductor 20X. The other end 39 of the second conductor 30X is open, and the second conductor 30X and first conductor 20X configure the half-wavelength resonator of linear shape (I shape) directed from the one end 28 and other end 29 of the first conductor 20X to the other end 39 of the second conductor 30X.

With the dual-band resonator 10X configured in this way, the AB plane extending in the Y direction along the center in the X direction forms an electrical/magnetic wall, and the odd-mode resonance occurs in the U-shaped half-wavelength resonator configured by the first conductor 20X, and the even-mode resonance occurs in the linear (I shaped) half-wavelength resonator configured by the first conductor 20X and second conductor 30X. The dual-band resonator 10X thereby resonates at the two frequencies (bands) of the odd-mode resonance frequency and the even-mode resonance frequency.

Figure 3A:
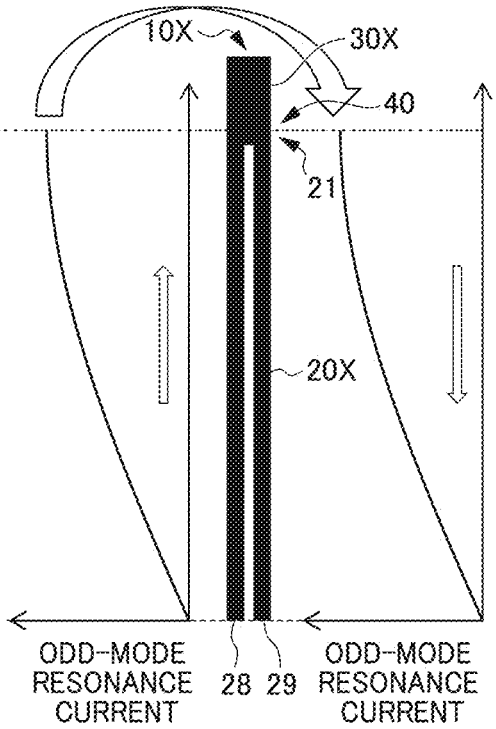
FIG. 3A is a schematic diagram of a current distribution of odd-mode resonation in the conventional dual-band resonator.
Figure 3B:
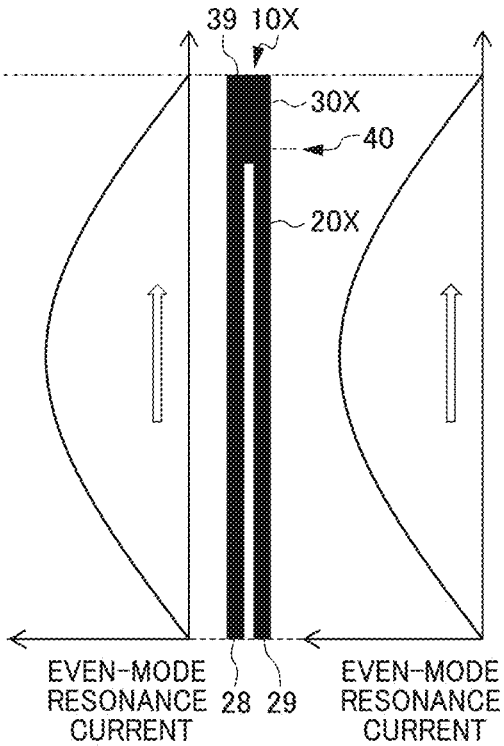
FIG. 3B is a schematic diagram of a current distribution of even-mode resonation in the conventional dual-band resonator.
Figure 4A:
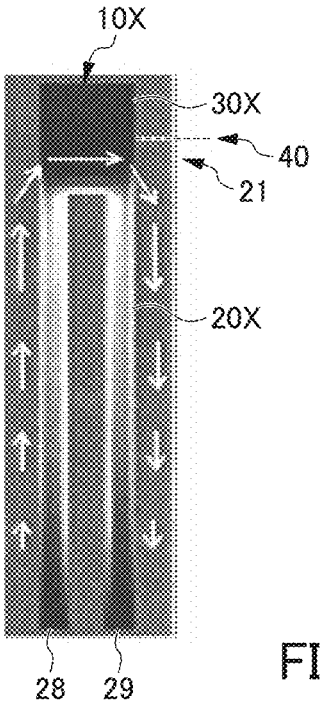
FIG. 4A is a simulation result of current distribution of odd-mode resonation in a conventional dual-band resonator.
Figure 4B:
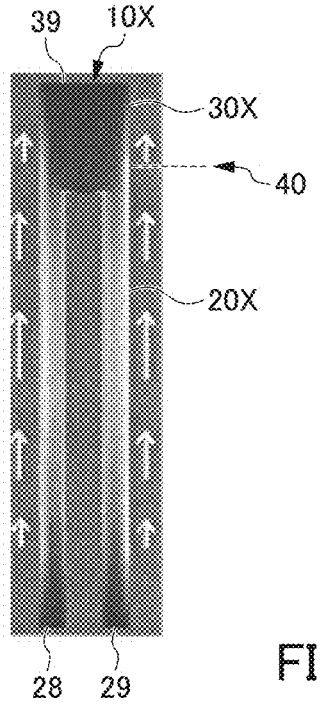
FIG. 4B is a simulation result of current distribution of even-mode resonation in a conventional dual-band resonator.

FIG. 3A is a schematic diagram of the current distribution of the odd-mode resonance in the conventional dual-band resonator 10X, and FIG. 3B is a schematic diagram of the current distribution of the even-mode resonance in the conventional dual-band resonator 10X. In addition, FIG. 4A is the simulation results of current distribution of odd-mode resonance in the conventional dual-band resonator 10X, and FIG. 4B is the simulation results of current distribution of even-mode resonance in the conventional dual-band resonator 10X. The simulations of FIG. 4A and FIG. 4B used an electromagnetic field analysis simulator SONNET EM (distributed by Sonnet Giken Corp.). The arrows in FIG. 3A and FIG. 3B and FIG. 4A and FIG. 4B indicate the direction of electrical current.

The one end 28 and other end 29 of the first conductor 20X are open ends (in other words, the first conductor 20X is a half-wavelength resonator), and the first folding part 21 is the central part of the first conductor 20X; therefore, as shown in FIG. 3A, the current of the odd-mode resonance in the first folding part 21 reaches a maximum, and the voltage becomes 0 V. In the odd-mode resonance, it is thereby possible to consider the interface 40 between the first conductor 20X and second conductor 30X as GND, and possible to ignore the influence of the second conductor 30X. For this reason, the resonance frequency of the odd mode is determined by the total length of the U-shaped first conductor 20.

According to the simulation results of FIG. 4A, the electrical current during odd-mode resonance flows to the first conductor 20X, and does not flow to the second conductor 30X. The second conductor 30X is thereby found to not influence the odd-mode resonance. In addition, the location at which the electrical current reaches a maximum is the first folding part 21 of the first conductor 20X. Consequently, during odd-mode resonance, it is found that the first conductor 20X operates as a half-wavelength resonator.

On the other hand, the one end 28 and other end 29 of the first conductor 20X as well as the other end 39 of the second conductor 30X are open ends (in other words, the first conductor 20X and second conductor 30X are linear half-wavelength resonators); therefore, the electrical current of the even-mode resonance reaches a maximum at the central part of the first conductor 20X and second conductor 30X, and the voltage becomes 0 V. For this reason, the resonance frequency of the even mode is determined mainly by the length from the one end 28 and other end 29 of the first conductor 20X until the other end 39 of the second conductor 30X.

According to the simulation results of FIG. 4B, the electrical current during even-mode resonance converges at the left/right side faces of the first conductor 20X and second conductor 30X without flowing to the electrical/magnetic wall of the AB plane. In addition, the location at which the electrical current reaches a maximum is the central part in the Y direction of the first conductor 20X and second conductor 30X. Consequently, during even-mode resonance, it is found that the first conductor 20X and second conductor 30X operate as linear half-wavelength resonators.

Referring again to FIG. 2, with the dual-band resonator 10X, when changing the length L1 of the first conductor 20X without changing the length L2 of the first conductor 20X and second conductor 30X (at this time, the length of the second conductor 30X also changes), it is thereby possible to adjust the resonance frequency of odd mode, without influencing the resonance frequency of the even mode. In addition, with the dual-band resonator 10X, by not changing the length L1 of the first conductor 20X, but changing the length L2 of the first conductor 20X and second conductor 30X (i.e. length of the second conductor 30X), it is possible to adjust the resonance frequency of the even mode without influencing the resonance frequency of the odd mode. The dual-band resonator 10X can thereby individually adjust the two resonance frequencies.

(Conventional Dual-Band Bandpass Filter)

Figure 5:
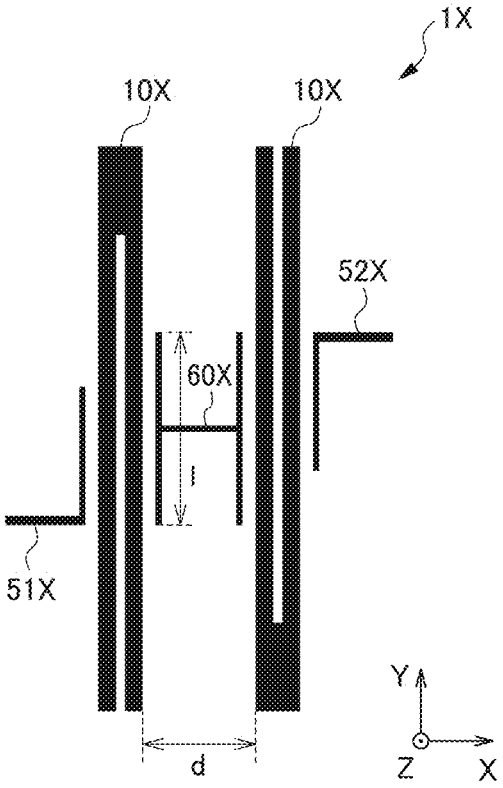
FIG. 5 is a plan view of a conventional dual-band bandpass filter.

FIG. 5 is a plan view of a conventional dual-band bandpass filter. The dual-band bandpass filter 1X shown in FIG. 5, similarly to the configuration shown in FIG. 1, is configured by a conductor of a microstrip line structure formed on a dielectric 11. The dual-band bandpass filter 1X includes feeder lines 51X, 52X, the two aforementioned dual-band resonators 10X and a wave guide 60X.

The feeder lines 51X, 52X are conductors for input/output of signals, and are arranged to interpose the dual-band resonators 10X in the X direction.

The dual-band resonators 10X are arranged in the X direction between the feeder lines 51X, 52X. The dual-band resonators 10X are arranged in different directions by 180 degrees from each other. In other words, the adjacent dual-band resonators 10X are arranged in different directions by 180 degrees from each other.

The wave guide 60X is an H-shaped conductor, and is arranged between the dual-band resonators 10X. The wave guide 60X is arranged at a central part of the dual-band resonators 10X in the Y direction.

According to this dual-band bandpass filter 1X, by changing the distance d between the dual-band resonators 10X, it is possible to adjust the coupling coefficient of the even mode, without influencing the coupling coefficient of the odd mode. On the other hand, by changing the length l of the waveguide 60X, it is possible to adjust the coupling coefficient of odd mode without influencing the coupling coefficient of the even mode. This is due to the following reasons.

The U-shaped first conductor 20X is near, and the directions of electrical current of the odd-mode resonation are the reverse each other; therefore, the magnetic field radiated to outside in the odd-mode resonance cancel each other to become small. For this reason, the coupling of the odd mode between adjacent dual-band resonators 10X becomes small. As a result thereof, in the coupling coefficient of the odd mode, the dependence on the distance d between the dual-band resonators 10X becomes small.

On the other hand, the waveguide 60X is arranged at the central part in the X direction, i.e. portion at which the electrical current of even-mode resonance is great and voltage is small, in other words, portion at which magnetic field coupling of even mode is large. Generally, the electric field coupling becomes dominant as conductors approach, and magnetic field coupling becomes dominant as conductors separate. With the waveguide 60X, since the electric field coupling becomes dominant, there is almost no coupling with the resonators of even mode. As a result thereof, in the coupling coefficient of even mode, the dependence on the length l of the waveguide 60X becomes small.

From the above, according to the dual-band bandpass filter 1X of the comparative example, it is possible to independently adjust the coupling coefficient of the odd mode and the coupling coefficient of the even mode.

Evaluation Result of Conventional Example

The dual-band bandpass filter 1X of the conventional example was designed and produced, and then evaluation was performed.

Figure 6:
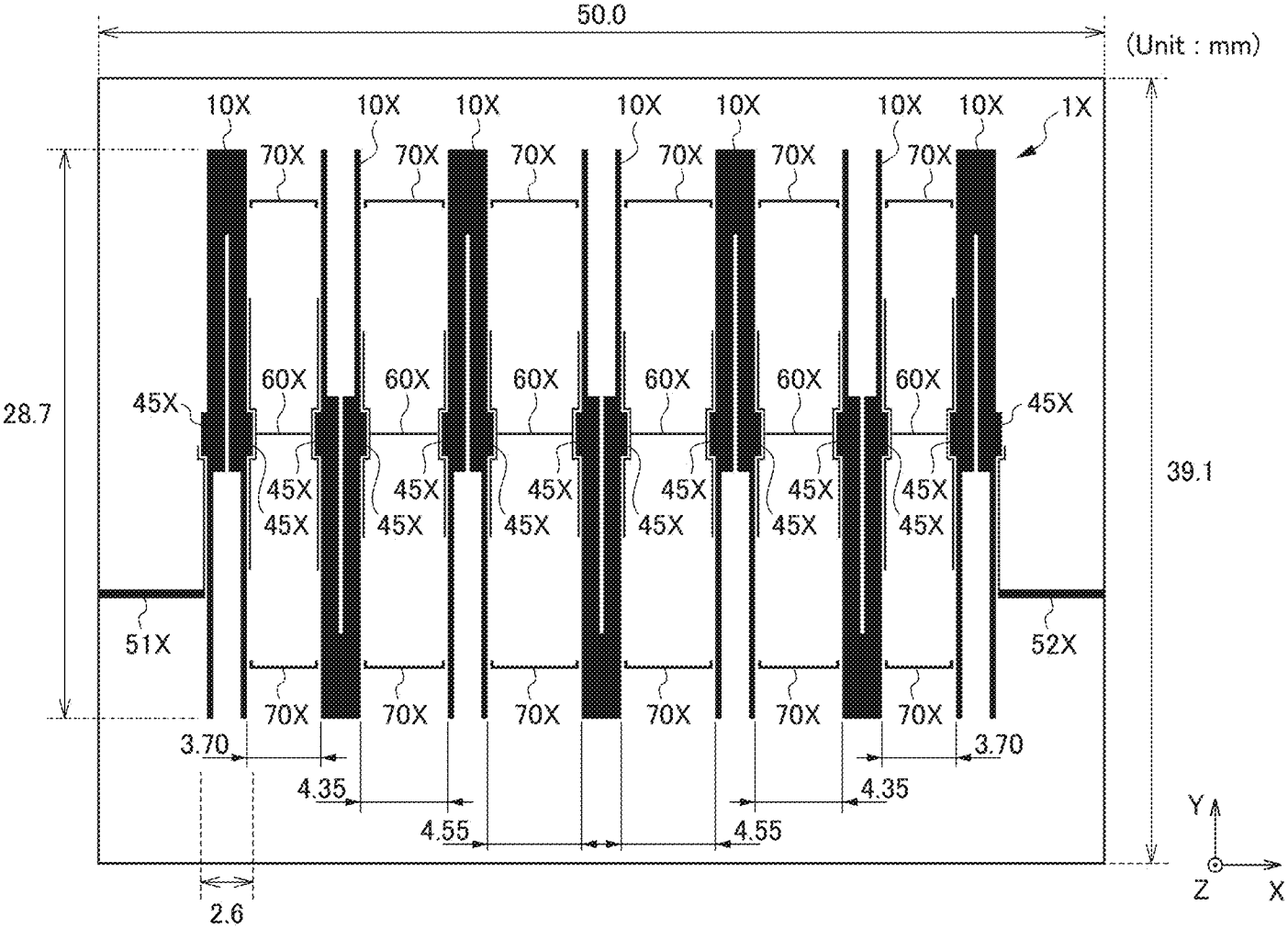
FIG. 6 is a plan view of a conventional example of a dual-band bandpass filter.

FIG. 6 is a plan view of the dual-band bandpass filter 1X of the conventional example which was designed and produced in a present evaluation. As shown in FIG. 6, the dual-band bandpass filter 1X of the conventional example designed and produced in the present evaluation includes seven stages of dual-band resonators 10X.

In addition, the dual-band resonator 10X adopts a stepped-impedance structure in the dual-band resonator 10X shown in FIG. 2 and FIG. 5. More specifically, near the one end 28 and the other end 29 of the conductor portions 26, 27 of the first conductor 20X is made thinner, and near the first folding part 21 is made thicker. Adjustment of the frequency of the even-mode resonance and frequency of the odd-mode resonance was thereby performed.

In addition, a protrusion 45X was provided at the central part in the Y direction of the first conductor 20X and second conductor 30X. At the central part in the Y direction of the first conductor 20X and second conductor 30X, since the electrical current of the even-mode resonance is a maximum, and the voltage is 0 V, the frequency of the even-mode resonance is not influenced by the protrusion 45X. Frequency adjustment of the odd-mode resonance was thereby performed.

In addition, the waveguide 70X was provided. The waveguide 70X is arranged so as to extend in the X direction in the vicinity of the second conductor 30X between the dual-band resonators 10X. Fine tuning of the coupling coefficient of the even mode was thereby performed.

In addition, as shown in FIG. 6, the distance d between dual-band resonators 10X is adjusted at each stage.

The design conditions and design parameters are as follows.

Figure 7A:
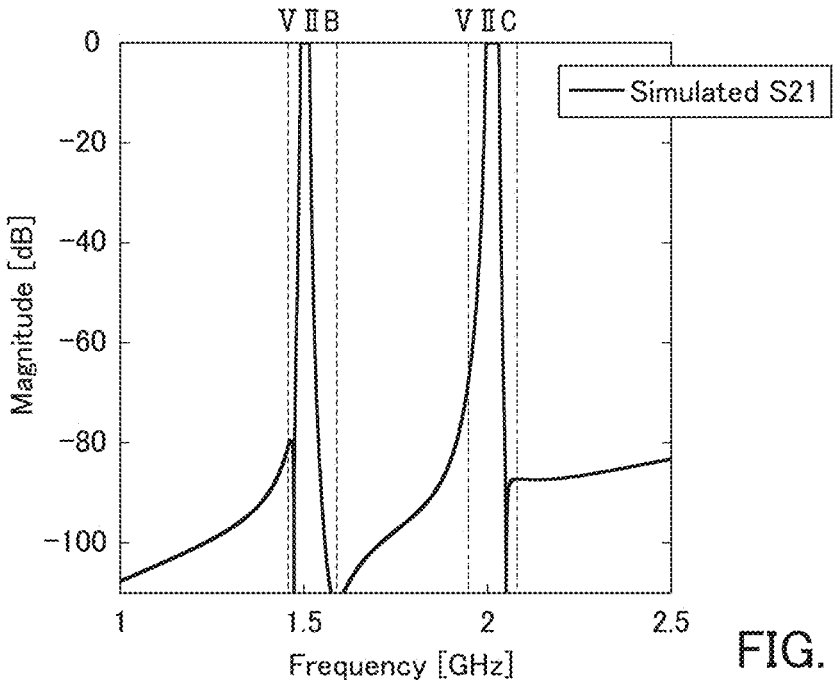
FIG. 7A is simulation results of an S parameter (S21 (pass characteristic)) during design of the conventional example in FIG. 6.
Figure 7B:
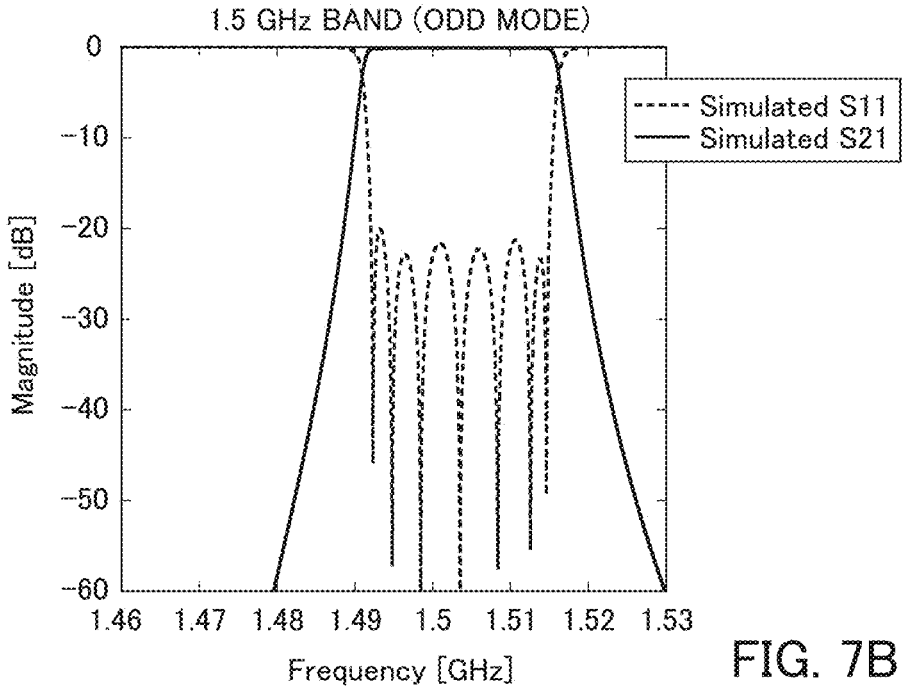
FIG. 7B is an enlarged view showing S21 (pass characteristic) and S11 (reflectance characteristic) of a VIIB portion (vicinity of odd-mode resonance frequency) in FIG. 7A to be enlarged.
Figure 7C:
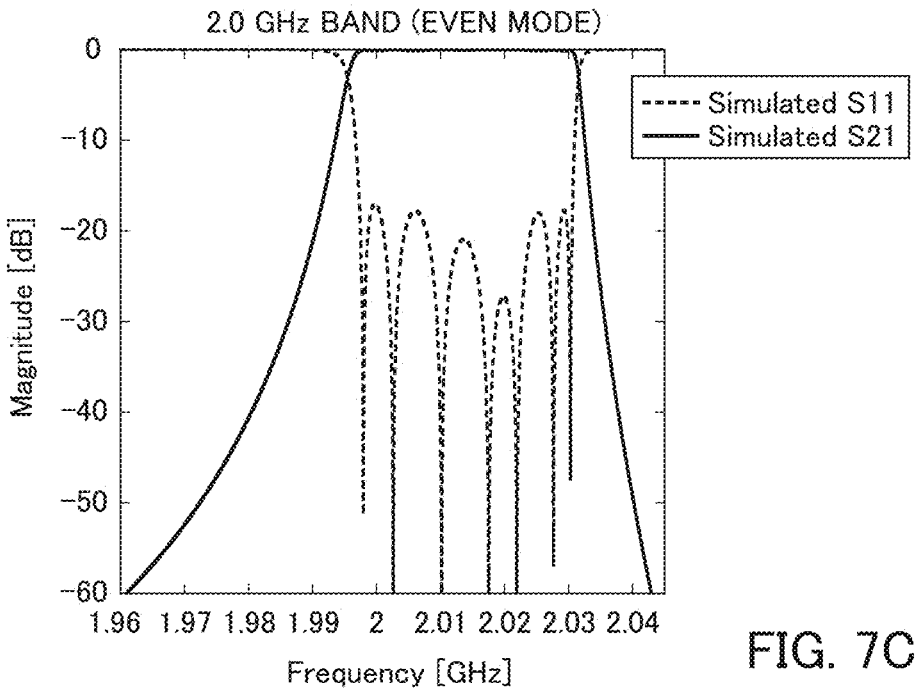
FIG. 7C is an enlarged view showing S21 (pass characteristic) and S11 (reflectance characteristic) of a VIIC portion (vicinity of even-mode resonance frequency) in FIG. 7A to be enlarged.

Resonance frequency of odd mode 1.5 GHz
Bandwidth of odd mode 22.5 MHz
Ripple of odd mode 0.03 dB
Resonance frequency of even mode 2.0 GHz
Bandwidth of even mode 30.0 MHz
Ripple of even mode 0.03 dB The simulation results of S parameters during design are shown in FIG. 7A to FIG. 7C. FIG. 7A shows S21 (pass characteristic) of the conventional example in FIG. 6; FIG. 7B shows S21 (pass characteristic) and S11 (reflectance characteristic) of the VIIB portion (vicinity of odd-mode resonance frequency) in FIG. 7A to be enlarged; and FIG. 7C shows S21 (pass characteristic) and S11 (reflectance characteristic) of the VIIC portion (vicinity of even-mode resonance frequency) in FIG. 7A to be enlarged. In the simulations of FIG. 7A to FIG. 7C, the electromagnetic analysis simulator SONNET EM (distributed by Sonnet Giken Corp.) was used.

Figure 8A:
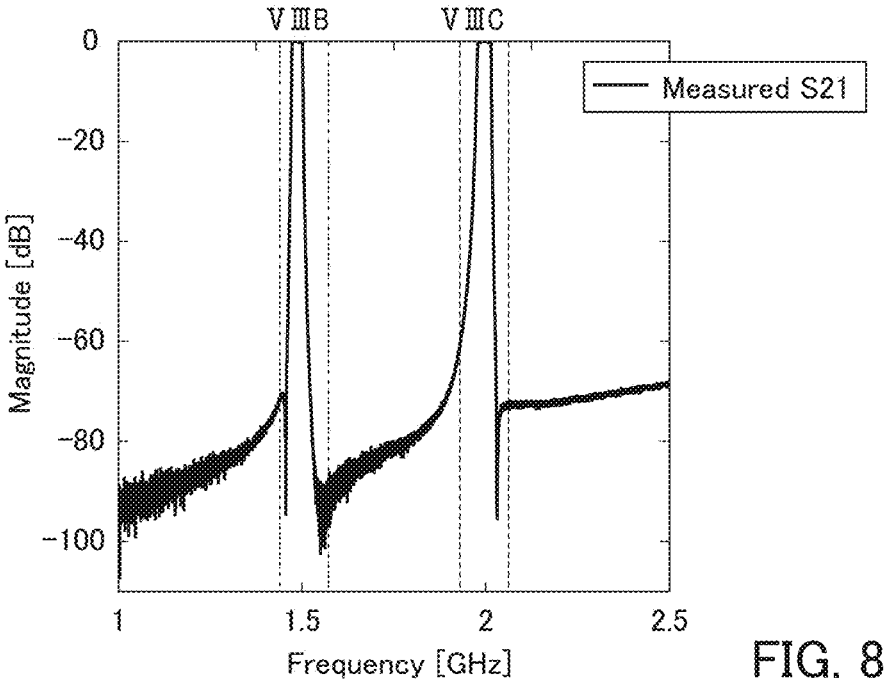
FIG. 8A is observation results of the S parameter (S21 (pass characteristic)) of the conventional example in FIG. 6.
Figure 8B:
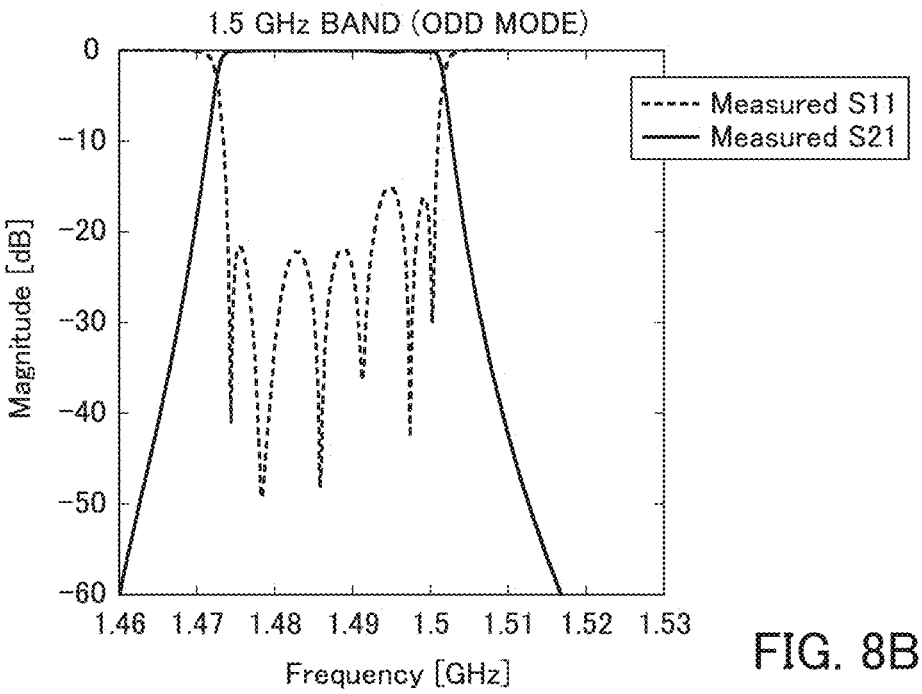
FIG. 8B is an enlarged view showing S21 (pass characteristic) and S11 (reflectance characteristic) of a VIIIB portion (vicinity of odd-mode resonance frequency) in FIG. 8A to be enlarged.
Figure 8C:
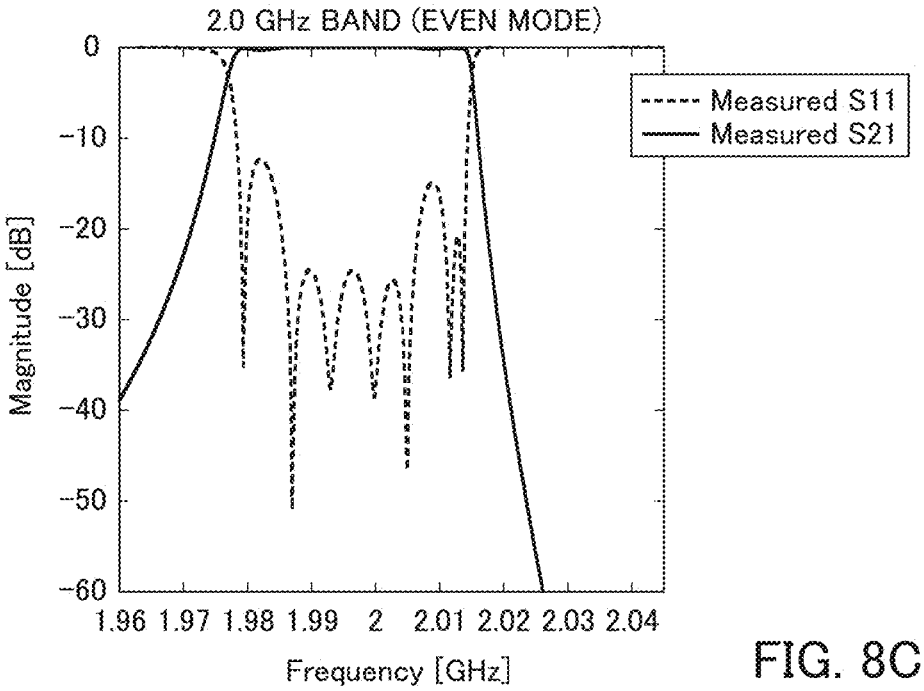
FIG. 8C is an enlarged view showing S21 (pass characteristic) and S11 (reflectance characteristic) of a VIIIC portion (vicinity of even-mode resonance frequency) in FIG. 8A to be enlarged.

In addition, the observation results of S parameters of the prepared conventional example are shown in FIG. 8A to FIG. 8C. FIG. 8A shows S21 (pass characteristics) of the convention example in FIG. 6; FIG. 8B shows S21 (pass characteristic) and S11 (reflectance characteristic) of the VIIIB portion (vicinity of odd-mode resonance frequency) in FIG. 8A to be enlarged; and FIG. 8C shows S21 (pass characteristic) and S11 (reflectance characteristic) of the VIIIC portion (vicinity of even-mode resonance frequency) in FIG. 8A to be enlarged. In the measurements of FIG. 8A to FIG. 8C, a network analyzer E5063A (manufactured by Keysight Technologies) was used.

According to FIG. 7A to FIG. 7C and FIG. 8A to FIG. 8C, it is possible to obtain observation results almost the same as the simulation results, whereby the effectiveness of the technique of the convention example was demonstrated.

Furthermore, the size of the dual-band resonator 10X of the conventional example in FIG. 6 was 2.6 mm (X direction)×28.7 mm (Y direction), and the size of the dual-band bandpass filter 1X of the conventional example in FIG. 6 was 50.0 mm (X direction)×39.1 mm (Y direction). With the dual-band resonator 10X and the dual-band bandpass filter 1X of the conventional example, by simultaneously realizing two frequency bands using the two modes generated by one resonator in this way, a size reduction more than using two independent resonators is possible.

Herein, with the conventional dual-band resonator 10X, the magnetic field radiated to outside of the even-mode resonance is relatively large, and the coupling of adjacent resonators upon configuring the filter is large. For this reason, in order to obtain a desired coupling in the even-mode resonance, the distance between resonators becomes large, and the size of the filter overall becomes relatively large.

Therefore, the present embodiment provides a dual-band resonator and dual-band bandpass filter enabling further size reduction compared to conventional.

Dual-Band Resonator According to Present Embodiment

Figure 9A:
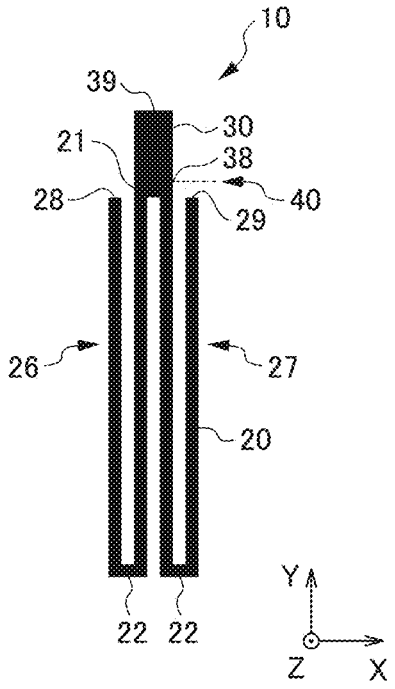
FIG. 9A is a plan view of a dual-band resonator according to the present embodiment.

FIG. 9A is a plan view of a dual-band resonator according to the present embodiment. The dual-band resonator 10 shown in FIG. 9A is configured by conductors of a microstrip line structure formed on a dielectric material, similarly to the conventional dual-band resonator 10X shown in FIG. 1.

As shown in FIG. 9A, the dual-band resonator 10 includes a first conductor 20 and second conductor 30.

The first conductor 20 adopts a structure folded in a U-shape by the first folding part 21 at the central part of the linear conductor, similarly to the conventional first conductor 20X shown in FIG. 2. A conductor portion 26 of the first conductor 20 more to a one end 28 side than the first folding part 21, and a conductor portion 27 of the first conductor 20 more to the other end 29 side than the first folding part 21 extend adjacently in the Y direction at a predetermined interval.

Furthermore, the conductor portion 26 and conductor portion 27 become a structure folded outwards at second folding parts 22 in the central part between the one end 28, other end 29 and the first folding part 21. In other words, the conductor portion 26 and conductor portion 27 become a structure folded in the direction in which the one end 28 and other end 29 separate from each other by the second folding part 22.

In other words, the conductor portion 26 becomes a structure folded in a direction distancing from the conductor portion 27 in the X direction by the second folding part 22, and the conductor portion 27 becomes a structure folded in a direction distancing from the conductor portion 26 in the X direction by the second folding part 22.

In the present embodiment, the conductor portion 26 and conductor portion 27 are formed so that the one end 28 and other end 29 are adjacent to the first folding part 21. It is thereby possible to get the most effect of the magnetic field radiated to outside in the even-mode resonance cancelling each other to become smaller, while enabling independent adjustment of the coupling coefficient of even mode by the waveguide 60 described later in FIG. 11.

It should be noted that the conductor portion 26 and conductor portion 27 may be folded to an extent that the one end 28 and other end 29 are adjacent to the conductor portion 26, 27 between the first folding part 21 and second folding part 22, or may be folded until the one end 28 and other end 29 are adjacent to the second conductor 30.

Both ends 28, 29 of the first conductor 20 are open, and the first conductor 20 configures a U-shaped half-wavelength resonator.

The second conductor 30, similarly to the conventional second conductor 30X shown in FIG. 2, has the one end 38 connected to the first folding part 21 of the first conductor 20, and extends in the Y direction contiguously to the first conductor 20. The other end 39 of the second conductor 30 is open, and the second conductor 30 and first conductor 20 configure a linear (I-shaped) half-wavelength resonator.

Figure 10A:
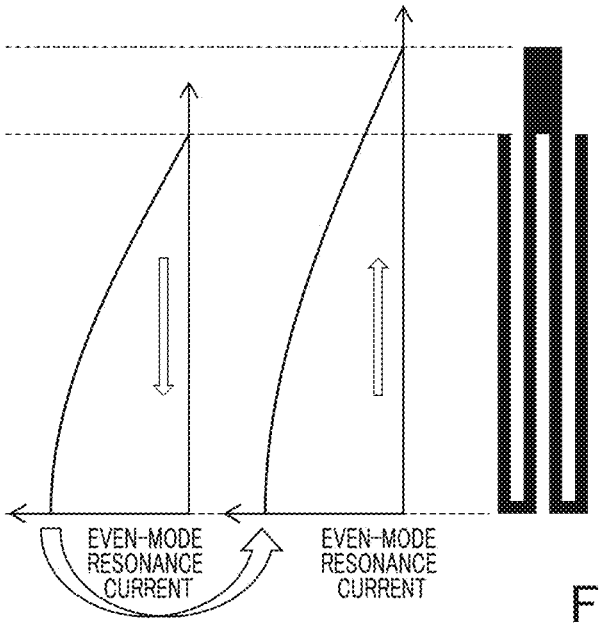
FIG. 10A is a schematic diagram of a current distribution of odd-mode resonance in the dual-band resonator of the present embodiment.

FIG. 10A is a schematic diagram of the electrical current distribution of the even-mode resonance of the dual-band resonator 10 of the present embodiment. FIG. 10A shows the electrical current distribution of the even-mode resonance in the conductor portion 26 more to the one end 28 side than the first folding part 21; however, it also applies to the electrical current distribution of even-mode resonance of the conductor portion 27 more to the other end 29 side than the first folding part 21. The arrows in the center indicate the direction of electrical current.

The second folding part 22 is in at the central part between the one end 28, other end 29 and the first folding part 21, i.e. in the vicinity of the central part between the first conductor 20 and second conductor 30; therefore, the electrical current of the even-mode resonance becomes substantially the maximum. As shown in FIG. 10A, in adjacent conductors of the conductor 26, the electrical currents of the even-mode resonance thereby become reverse to each other, and the magnitudes of electrical current of the even-mode resonance become substantially equal. For this reason, the magnetic fields radiated to outside in the even-mode resonance cancel each other to become smaller.

It should be noted that, in the odd-mode resonance, since the conductor portions at which the electrical current in the odd-mode resonance are adjacent from the first folding part 21 until the second folding part 22, the magnetic fields radiated to outside in the odd-mode resonance cancel each other to become smaller as mentioned above.

Other Dual-Band Resonator According to Present Embodiment

Figure 9B:
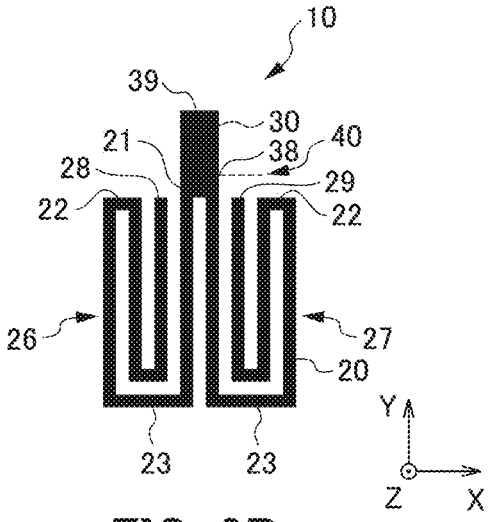
FIG. 9B is a plan view of another dual-band resonator according to the present embodiment.

FIG. 9B is a plan view of a dual-band resonator according to the present embodiment. The dual-band resonator 10 shown in FIG. 9B differs in the configuration of the first conductor 20 of the dual-band resonator 10 of the present embodiment shown in FIG. 9A.

With the first conductor 20, the folded conductor portion 26 and conductor portion 27 in the first conductor 20 shown in FIG. 9A become a structure further folded to outside by a third folding part 23 which is a central part between the one end 28, other end 29 and the first folding part 21 and second folding part 22. In other words, the folded conductor portion 26 and conductor portion 27 become a structure folded in a direction in which the second folding parts 22 separate from each other by the third folding part 23.

In other words, the folded conductor portion 26 becomes a structure folded at the third folding part 23 in a direction separating from the conductor portion 27 in the X direction, and the folded conductor portion 27 becomes a structure folded at the third folding part 23 in a direction separating from the conductor portion 26 in the X direction.

In the present embodiment, the first folding part 21, one end 28, and second folding part 22 are arranged in order linearly in the X direction in the conductor portion 26, and the first folding part 21, other end 29 and second folding part 22 are arranged in order linearly in the X direction in the conductor portion 27.

It should be noted that the first folding part 21, one end 28 and second folding part 22 may not necessarily be arranged linearly in the X direction. In addition, the first folding part 21, other end 29 and second folding part 22 may not necessarily be arranged linearly in the X direction. More specifically, the first folding part 21, one end 28 and second folding part 22 may be arranged in the X direction while shifting in the Y direction. In addition, the first folding part 21, other end 29 and second folding part 22 may be arranged in the X direction while shifting in the Y direction.

Furthermore, the folded conductor portion 26 and conductor portion 27 may become a further folded structure. In this case, in the conductor portion 26, the first folding part 21, one end 28, second folding part 22, third folding part 23, . . . may be arranged in order in the X direction, and in the conductor portion 27, the first folding part 21, other end 29, second folding part 22, third folding part 23, . . . may be arranged in order in the X direction.

Figure 10B:
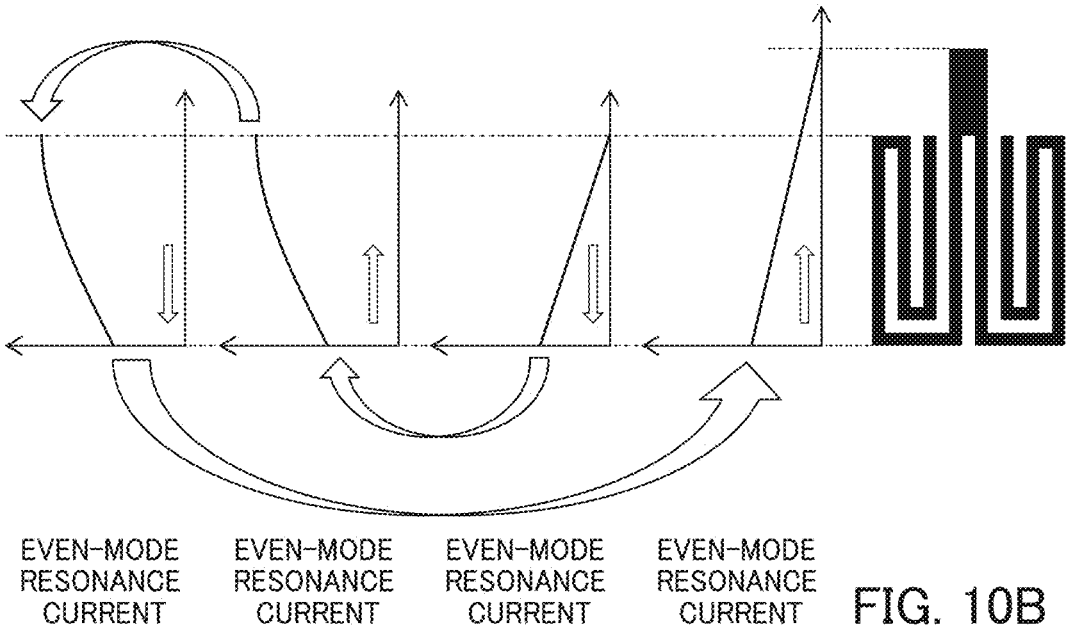
FIG. 10B is a schematic diagram of a current distribution of odd-mode resonance in another dual-band resonator of the present embodiment.

FIG. 10B is a schematic diagram of the electrical current distribution of even-mode resonance in another dual-band resonator 10 of the present embodiment. FIG. 10B shows the electrical current distribution of even-mode resonance in the conductor portion 26 more to a side of the one end 28 than the first folding part 21; however, the same also applies to the electrical current distribution of the even-mode resonance of the conductor portion 27 more to a side of the other end 29 than the first folding part 21. The arrows in the drawing indicate the direction of electrical current.

The third folding part 23 is at the central part between the one end 28, other end 29 and the first folding part 21 and second folding part 22, i.e. is near ¼ of the first conductor 20 and second conductor; therefore, the electrical current of the even-mode resonance becomes about ½ of the maximum value. As shown in FIG. 10B, in adjacent conductors of the conductor portion 26, the electrical currents of even-mode resonance thereby becomes reverse each other, and the magnitudes of electrical current of the even-mode resonance become almost equal. For this reason, the magnetic fields radiated to outside in the even-mode resonance cancel each other to become smaller.

It should be noted that, in odd-mode resonance, since the conductor portions are adjacent at which electrical current of odd-mode resonance from the first folding part 21 until the third folding part 23 is a maximum, the magnetic fields radiated to outside in odd-mode resonance cancel each other to become smaller.

As explained above, according to the dual-band resonator 10 of the present embodiment, by the conductor portion 26 and conductor portion 27 in the first conductor part 20 becoming a structure folded in the direction in which the one end 28 and other end 29 separate from each other by the first folding part 21, a size reduction of the dual-band resonator 10 is possible compared to the conventional dual-band resonator 10X.

Furthermore, according to the dual-band resonator 10 of the present embodiment, by the conductor portion 26 and conductor portion 27 becoming a structure folded in a direction in which the second folding parts 22 separate from each other by the third folding part 23, a further size reduction of the dual-band resonator 10 is possible.

In addition, by becoming a structure in which the conductor portion 26 and conductor portion 27 are folded as mentioned above, the electrical currents of even-mode resonance becomes reverse directions to each other in adjacent conductors, and the magnitudes of electrical current of even-mode resonance becomes substantially equal; therefore, the magnetic fields radiated to outside in the even-mode resonance cancel each other to become smaller. Upon configuring a filter, not only the coupling of odd mode in adjacent resonators, but also coupling of even mode becomes smaller, and it is thereby possible to make the distance between resonators smaller. As a result thereof, a size reduction of the filter is possible.

Dual-Band Bandpass Filter According to Present Embodiment

Figure 11:
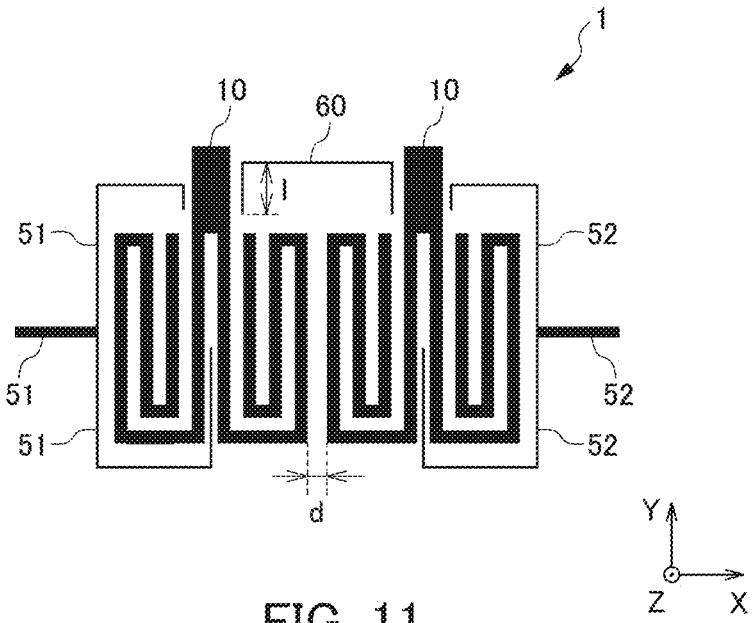
FIG. 11 is a plan view of a dual-band bandpass filter according to the present embodiment.

FIG. 11 is a plan view of a dual-band bandpass filter according to the present embodiment. The dual-band bandpass filter 1 shown in FIG. 11 is configured by conductors of a microstrip line structure formed on a dielectric material, similarly to the conventional dual-band resonator 10X shown in FIG. 1. The dual-band bandpass filter 1 includes feeder lines 51, 52, two of the aforementioned dual-band resonators 10 and waveguide 60, similarly to the dual-band bandpass filter 1X shown in FIG. 5.

The feeder lines 51, 52 are conductors for input/output of signals, and are arranged so as to interpose the dual-band resonator 10 in the X direction. The feeder lines 51, 52 are independently coupled to the first conductor 20 and second conductor 30.

The dual-band resonator 10 is arranged in the X direction between the feeder lines 51, 52.

The waveguide 60 is a conductor connecting the L-shaped conductor and reverse L-shaped conductor, and is arranged between the dual-band resonators 10. The waveguide 60 is arranged so as to be adjacent to the second conductor 30 in the Y direction.

According to this dual-band bandpass filter 1, not only coupling of the odd mode, but also coupling of the even mode is small; therefore, it is possible to make the interval of dual-band resonators 10 smaller. In the present embodiment, by changing the distance d between the dual-band resonators 10, the coupling coefficient of the odd mode is adjusted. At this time, since the coupling coefficient of the even mode is also adjusted but not sufficient, by changing the length l of the waveguide 60, it is possible to adjust the coupling coefficient of the even mode without influencing the coupling coefficient of the odd mode. According to the dual-band bandpass filter 1, it is thereby possible to independently adjust the coupling coefficient of odd mode and the coupling coefficient of even mode.

In addition, according to this dual-band bandpass filter 1, the feeder lines 51, 52 are independently coupled to the first conductor 20 and second conductor 30; therefore, it is possible to independently adjust the external Q value of the odd mode and the external Q value of the even mode. External Q value represents the intensity of coupling between the feeder line and resonator.

However, in the case of implementing a narrowband filter, since the coupling between resonators must be made small in design, it is necessary to widen the distance between resonators. According to this dual-band bandpass filter 1, since the coupling between resonators is small, the distance between resonators does not need to be widened, and as a result thereof, it is possible for a small-narrowband dual-band bandpass filter to be realized.

However, in order to effectively use frequency resources, a steep cutoff characteristic is demanded in the bandpass filter. In order to obtain a steep cutoff characteristic, it has been considered to make resonators of many stages; however, the loss will increase, and thus the performance as a filter deteriorates. Therefore, a superconductor may be used as the first conductor and second conductor. Superconductor has surface resistance that is two or three orders of magnitude smaller in microwave band compared to normal metals such as copper. For this reason, even if making the resonators into multiple stages, it is possible to realize a steep cutoff characteristic while maintain low loss.

AS explained above, according to the dual-band bandpass filter 1 of the present embodiment, since the aforementioned dual-band resonators are included, not only the coupling of odd mode in adjacent resonators, but also coupling of even mode becomes smaller, and it is possible to make the distance between resonators smaller. As a result thereof, a size reduction of the filter is possible.

In addition, according to the dual-band bandpass filter 1 of the present embodiment, since it is possible to make the distance between resonators smaller as mentioned above, it is possible for a small narrowband dual-band bandpass filter to be realized.

In addition, according to the dual-band bandpass filter 1 of the present embodiment, since it is possible to make the distance between resonators smaller as mentioned above, it becomes possible to make the resonators in multiple stages, and thus a steep cutoff characteristic can be realized.

In addition, according to the dual-band bandpass filter 1 of the present embodiment, since not only the coupling of the odd mode, but also coupling of the even mode is small, it is possible to reduce the unwanted jump over cross coupling other than adjacent resonators, and as a result thereof, a multi-stage design becomes easy.

Dual-Band Resonator According to Modified Example of Present Embodiment

Figure 12:
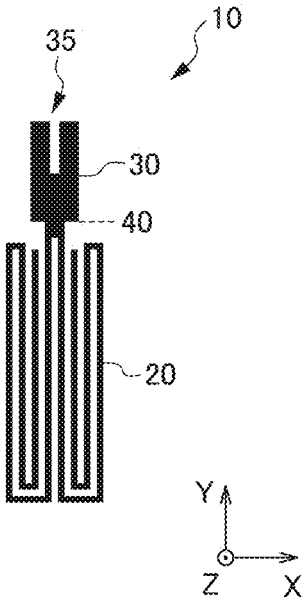
FIG. 12 is a plan view of a dual-band resonator according to a modified example of the present embodiment.

FIG. 12 is a plan view of a dual-band resonator according to a modified example of the present embodiment. As shown in FIG. 12, in the dual-band resonator 10 shown in FIG. 9B, a stepped impedance structure may be adopted. More specifically, the dual-band resonator 10 may be a structure thinning the first conductor 20 and thickening the second conductor 30. It is thereby possible to perform frequency adjustment of the even mode and odd mode. In addition, a further size reduction of the resonator is possible.

In addition, a recess 35 may be provided to an end part of the second conductor 30 on the side of the other end 39. By adjusting the depth of the groove of the recess 35, it is possible to fine tune the frequency of the even-mode resonance compared to a case of adjusting the end part overall of the other end 39 of the second conductor 30. The formation position of the recess 35 is preferably the central part of the end part of the second conductor 30 on the side of the other end 39. It is thereby possible to perform fine tuning of the frequency of even-mode resonance without influencing the adjustment of the coupling coefficient of the even mode by the waveguide 60 shown in FIG. 11.

In addition, a convex part may be provided in place of the recess 35 to an end part of the second conductor 30 on the side of the other end 39. In this case, by adjusting the length of the protrusion of the convex part, it is possible to fine tune the frequency of even-mode resonance.

Figure 13:
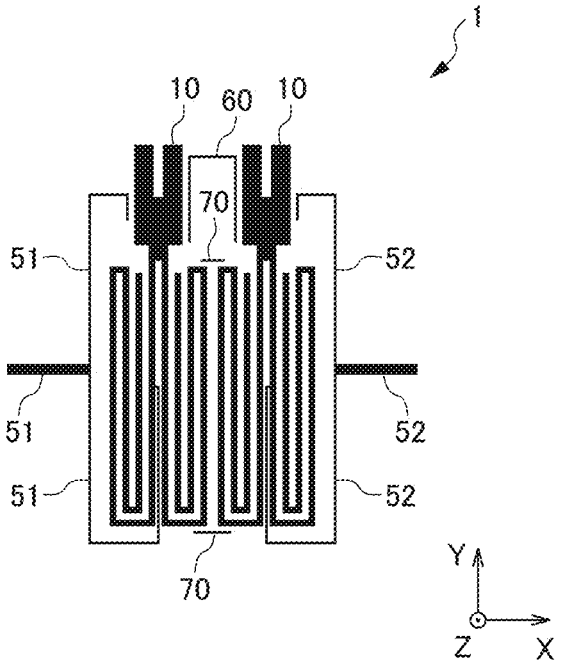
FIG. 13 is a plan view of a dual-band bandpass filter according to a modified example of the present embodiment.

Dual-Band Bandpass Filter According to Modified Example of Present Embodiment FIG. 13 is a plan view of a dual-band bandpass filter according to a modified example of the present embodiment. As shown in FIG. 13, in the dual-band bandpass filter 1 shown in FIG. 11, the dual-band resonator 10 of FIG. 12 may be adopted as the dual-band resonator 10.

In addition, it may further include an I-shaped waveguide 70. The waveguide 70 is arranged in the vicinity of the second folding part 22 and/or vicinity of the third folding part 23 between dual-band resonators 10 so as to extend in the X direction. It is thereby possible to fine tune the coupling coefficient of the odd mode.

Evaluation Results of Examples

The dual-band bandpass filter 1 of the example was designed and produced, and then evaluation was carried out.

Figure 14:
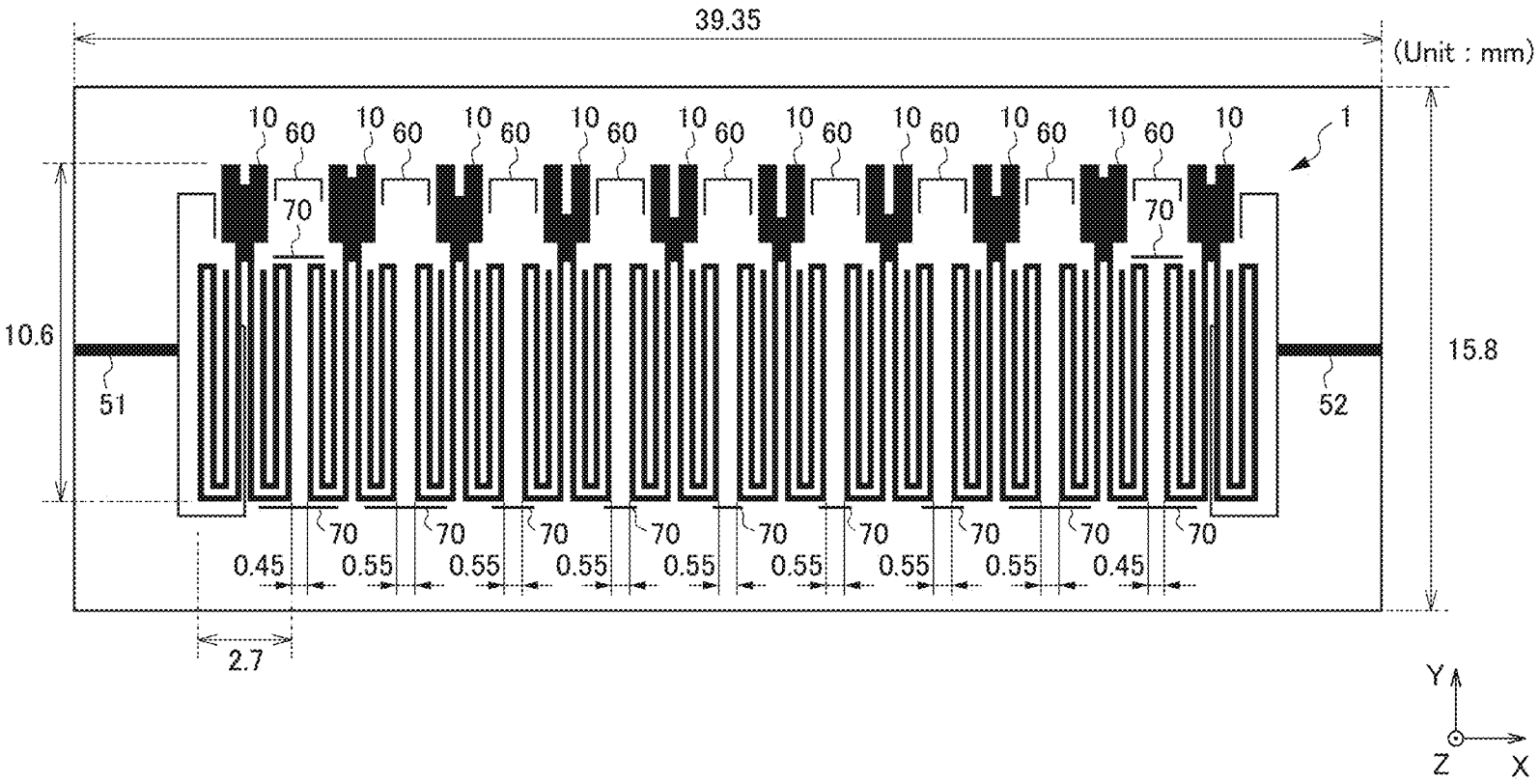
FIG. 14 is a plan view of the dual-band bandpass filter of the present example.

FIG. 14 is a plan view of a dual-band bandpass filter 1 of an example designed and produced in the present evaluation. As shown in FIG. 14, the dual-band bandpass filter 1 of the example designed and produced in the present evaluation includes ten stages of dual-band resonators 10 in accordance with the configuration of the dual-band bandpass filter 1 shown in FIG. 13.

As shown in FIG. 14, in each stage, the distance d between the dual-band resonators 10, presence/absence and length of the waveguide 70 and depth of the recess 35 are adjusted.

The design conditions and design parameters are as follows.

Figure 15A:
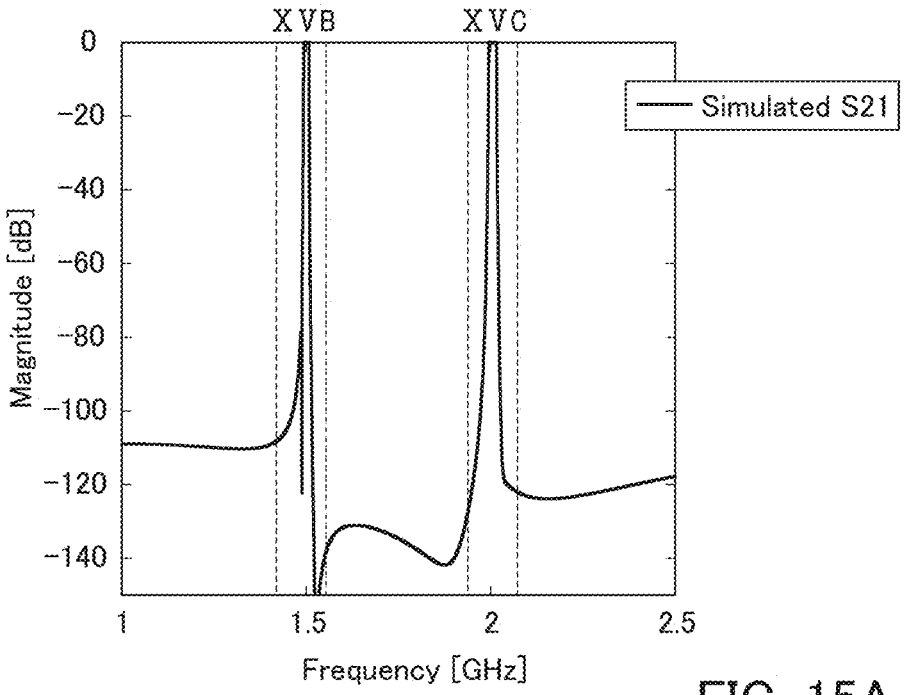
FIG. 15A is simulation results of the S parameter (S21 (pass characteristic)) during design of the example in FIG. 14.
Figure 15B:
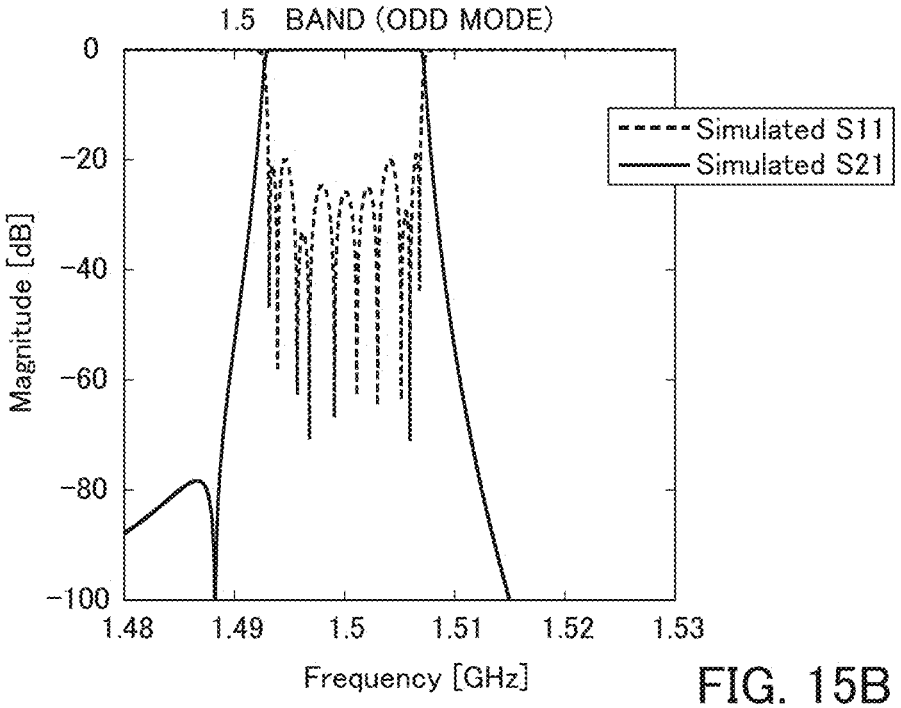
FIG. 15B is an enlarged view showing S21 (pass characteristic) and S11 (reflectance characteristic) of an XVB portion (vicinity of odd-mode resonance frequency) in FIG. 15A to be enlarged.
Figure 15C:
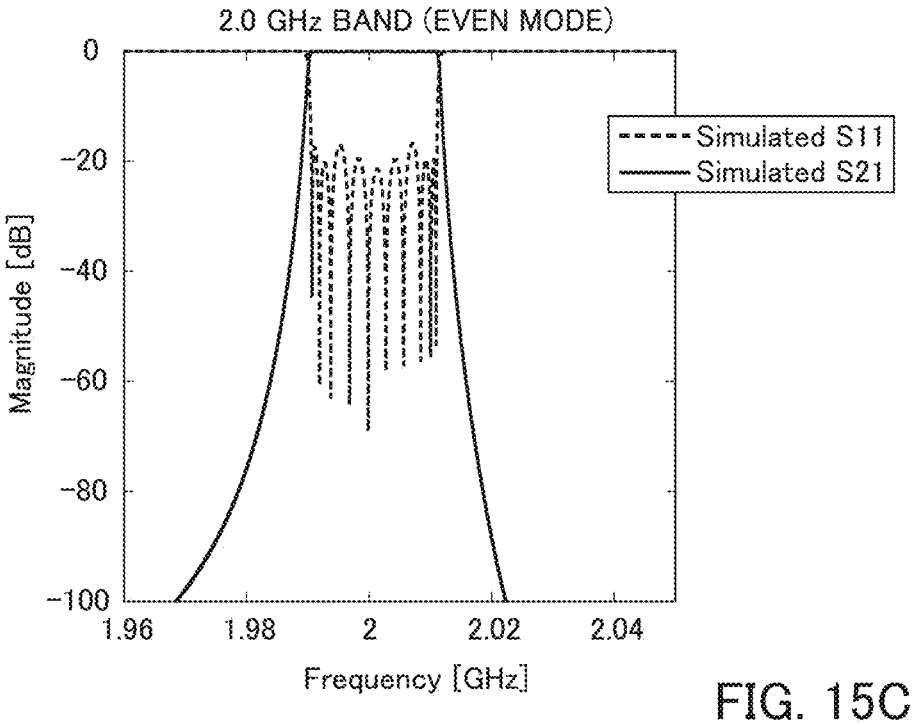
FIG. 15C is an enlarged view showing S21 (pass characteristic) and S11 (reflectance characteristic) of an XVC portion (vicinity of even-mode resonance frequency) in FIG. 15A to be enlarged.

Resonance frequency of odd mode 1.5 GHz
Bandwidth of odd mode 15 MHz
Ripple of odd mode 0.03 dB
Resonance frequency of even mode 2.0 GHz
Bandwidth of even mode 20 MHz
Ripple of even mode 0.03 dB Simulation results of the S parameter during design are shown in FIG. 15A to FIG. 15C. FIG. 15A shows S21 (pass characteristic) of the example in FIG. 14; FIG. 15B shows S21 (pass characteristic) and S11 (reflectance characteristic) of the XVB portion (vicinity of odd-mode resonance frequency) in FIG. 15A to be enlarged; and FIG. 15C shows S21 (pass characteristic) and S11 (reflectance characteristic) of the XVC portion (vicinity of even-mode resonance frequency) in FIG. 15A to be enlarged. The simulations of FIG. 15A to FIG. 15C used an electromagnetic field analysis simulator SONNET EM (distributed by Sonnet Giken Corp.).

Figure 16A:
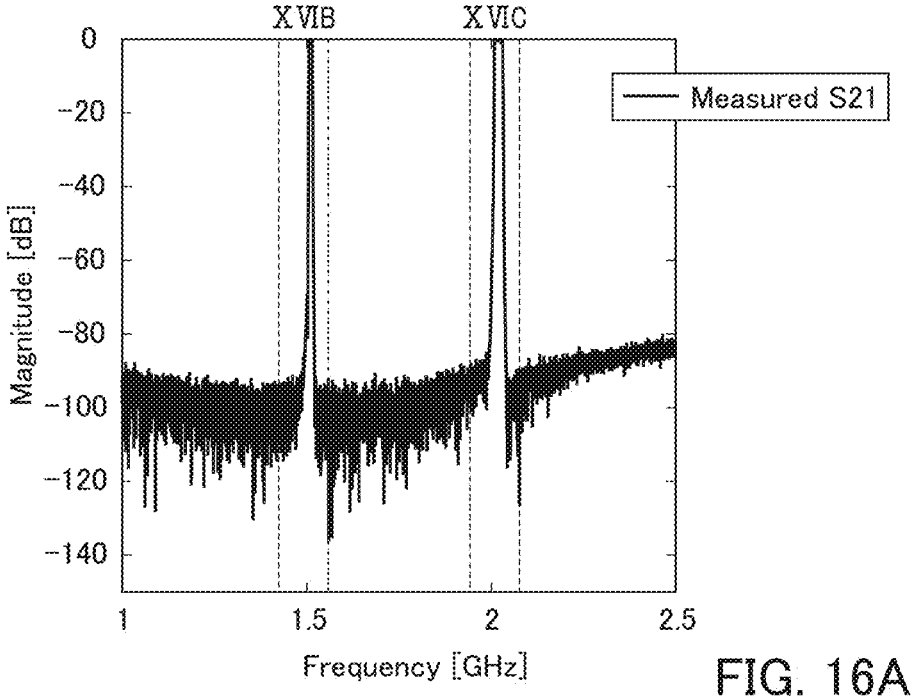
FIG. 16A is observation results of the S parameter (S21 (pass characteristic)) of the example in FIG. 14.
Figure 16B:
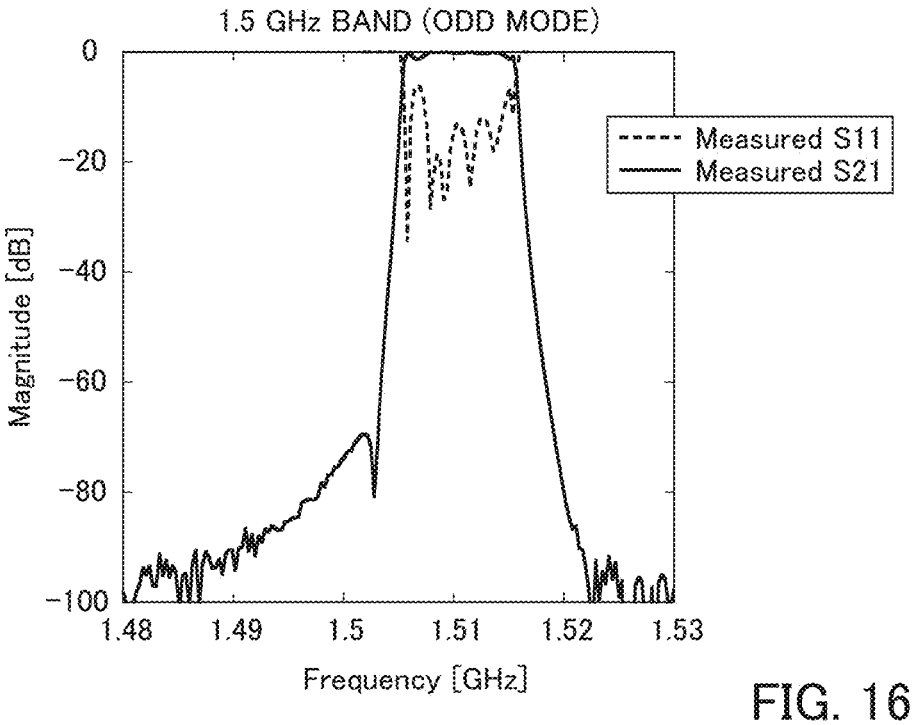
FIG. 16B is an enlarged view showing S21 (pass characteristic) and S11 (reflectance characteristic) of an XVIB portion (vicinity of odd-mode resonance frequency) in FIG. 16A to be enlarged.
Figure 16C:
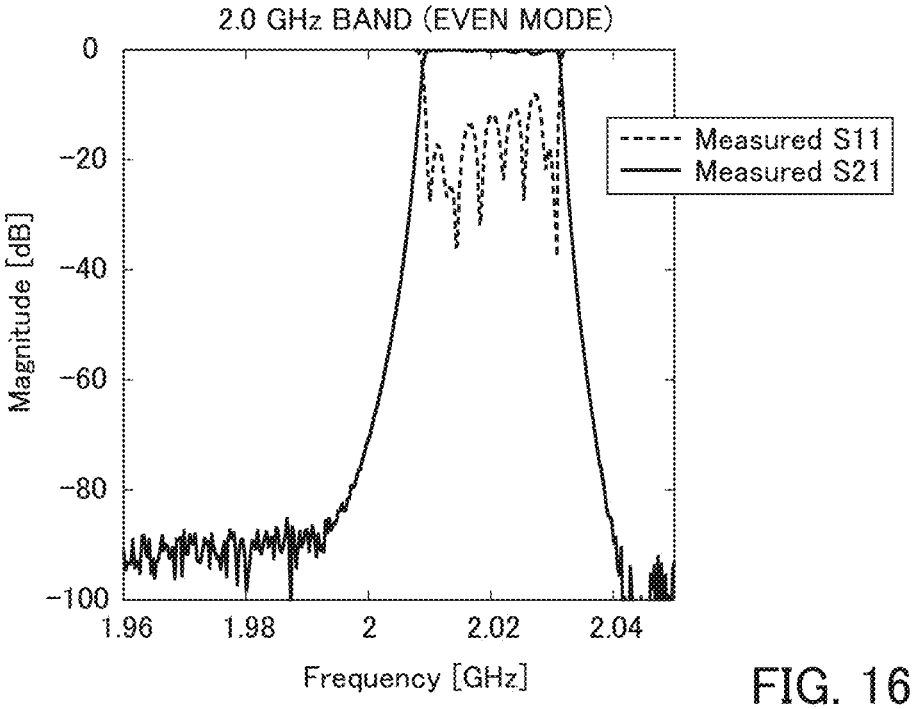
FIG. 16C is an enlarged view showing S21 (pass characteristic) and S11 (reflectance characteristic) of an XVIC portion (vicinity of even-mode resonance frequency) in FIG. 16A to be enlarged.

In addition, the observation results of the S parameter of the prepared example are shown in FIG. 16A to FIG. 16C. FIG. 16A shows S21 (pass characteristic) of the example in FIG. 14; FIG. 16B shows S21 (pass characteristic) and S11 (reflectance characteristic) of the XVIB portion (vicinity of odd-mode resonance frequency) in FIG. 16A to be enlarged; and FIG. 16C shows S21 (pass characteristic) and S11 (reflectance characteristic) of the XVIC portion (vicinity of even-mode resonance frequency) in FIG. 16A to be enlarged. In the measurements of FIG. 16A to FIG. 16C, a network analyzer E5063A (manufactured by Keysight Technologies) was used.

According to FIG. 15A to FIG. 15C and FIG. 16A to FIG. 16C, it is possible to obtain observation results almost the same as the simulation results, whereby the effectiveness of the technique of the example was demonstrated.

In addition, by making the dual-band resonators 10 into multiple stages often stages, it was possible to realize a steep cutoff characteristic.

Furthermore, the size of the dual-band resonator 10 of the example in FIG. 14 was 2.7 mm (X direction)×10.6 mm (Y direction), and the size of the dual-band bandpass filter 1 of the example in FIG. 14 was 39.35 mm (X direction)×15.8 mm (Y direction). For the dual-band resonator 10 and dual-band bandpass filter 1 of the example, a size reduction is thereby possible compared to the dual-band resonator 10X and dual-band bandpass filter 1X of the aforementioned conventional example.

It should be noted that, in the example, the resonator length was adjusted so that the odd-mode resonates at the low frequency side and the even-mode resonator resonates at the high frequency side; however, it may be adjusted so that the odd-mode resonates at the high frequency side and the even-mode resonator resonates at the low frequency side.

Although an embodiment of the present invention has been explained above, the present invention is not to be limited to the aforementioned embodiment, and modifications are possible where appropriate.

EXPLANATION OF REFERENCE NUMERALS

1, 1X dual-band bandpass filter
10, 10X dual-band resonator

11 dielectric
12 ground conductor
20, 20X first conductor
21 first folding part
22 second folding part
23 third folding part
26 conductor portion of one end side
27 conductor portion of other end side
28 one end
29 other end
30, 30X second conductor
35 recess
38 one end
39 other end
40 interface
51, 51X, 52, 52X feeder line
60, 60X, 70, 70X waveguide

The invention claimed is:

1. A dual-band resonator which resonates at two different frequencies, comprising:

a first conductor and a second conductor which are formed on a dielectric having a ground conductor or inside a dielectric having a ground conductor, wherein the first conductor is folded in a U shape by a first folding part in a central part, and extends in a predetermined direction adjacently at a predetermined interval, wherein a one-end-side conductor portion which is more to one end side of the first conductor than the first folding part and an other-end-side conductor portion which is more to an other end side of the first conductor than the first folding part become a structure further folded in a direction in which one end and an other end distance from each other, at second folding parts between the one end, the other end and the first folding part, wherein the second conductor has one end connected to the first folding part of the first conductor, and extends in the predetermined direction continuously to the first conductor, wherein two ends of the first conductor are open, the first conductor constitutes a half-wavelength resonator, and odd-mode resonance resonating at one frequency among the two frequencies is produced at the first conductor, and wherein an other end of the second conductor is open, the first conductor and the second conductor constitute a half-wavelength resonator, and even-mode resonance resonating at an other frequency among the two frequencies is produced at the first conductor and the second conductor.

2. The dual-band resonator according to claim 1, wherein the one-end-side conductor portion and the other-end-side conductor portion form a structure further folded in a direction in which the second folding parts distance from each other, at third folding parts between the one end of the first conductor, the other end of the first conductor, and the first folding part and the second folding part.

3. The dual-band resonator according to claim 2, wherein the first folding part, the one end of the first conductor, and the second folding part are arranged in order in a cross direction intersecting the predetermined direction, in the one-end-side conductor portion, and wherein the first folding part, the other end of the first conductor and the second folding part are arranged in order in the cross direction in the other-end-side conductor portion.

4. The dual-band resonator according to claim 3, wherein the first folding part, the one end of the first conductor and the second folding part are arranged linearly in the cross direction in the one-end-side conductor portion, and wherein the first folding part, the other end of the first conductor and the second folding part are arranged linearly in the cross direction in the other-end-side conductor portion.

5. The dual-band resonator according to claim 1, wherein the first conductor is made thinner than the second conductor and the second conductor is established as a stepped-impedance structure.

6. The dual-band resonator according to claim 1, wherein a recessed part or convex part is formed at an end part of the second conductor on a side of the other end thereof.

7. A dual-band bandpass filter comprising one or a plurality of the dual-band resonators according to claim 1.

8. The dual-band bandpass filter according to claim 7, comprising:

the plurality of dual-band resonators arranged so as to satisfy a coupling coefficient of a corresponding odd-mode resonance; and one or a plurality of waveguides provided between second conductors of the plurality of the dual-band resonators so as to satisfy a coupling coefficient of even-mode resonance.

9. The dual-band bandpass filter according to claim 8, further comprising a pair of feeder lines provided so as to interpose the plurality of the dual-band resonators, and coupled independently to a first conductor and a second conductor of one of the plurality of dual-band resonators.

* * * * *